US010058174B1

(12) United States Patent
Tang

(10) Patent No.: US 10,058,174 B1
(45) Date of Patent: Aug. 28, 2018

(54) SHELF STRUCTURE

(71) Applicant: Pao-Hsun Tang, Changhua (TW)

(72) Inventor: Pao-Hsun Tang, Changhua (TW)

(73) Assignee: Malzine Co. Ltd., Changhua (TW)

( * ) Notice: Subject to any disclaimer, the term of this patent is extended or adjusted under 35 U.S.C. 154(b) by 0 days.

(21) Appl. No.: 15/585,001

(22) Filed: May 2, 2017

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47B 57/54*** | (2006.01) |
| ***A47B 57/34*** | (2006.01) |

(52) U.S. Cl.
CPC ..... *A47B 57/545* (2013.01); *A47B 47/0083* (2013.01); *A47B 57/34* (2013.01)

(58) Field of Classification Search
CPC ..... A47B 57/545; A47B 57/34; A47B 57/00; A47B 57/06; A47B 57/08; A47B 57/26; A47B 57/265; A47B 57/30; A47B 57/32; A47B 57/54; A47B 57/562; A47B 57/567; A47B 47/00; A47B 47/0083; A47B 47/02; A47B 47/021; A47B 47/045; A47F 5/10; A47F 5/101
USPC ..... 211/187, 190, 207; 108/147.11–147.18, 108/190, 192, 95, 96, 106, 107
See application file for complete search history.

(56) References Cited

U.S. PATENT DOCUMENTS 4,318,352 A * 3/1982 Friedman ..... A47B 57/265 108/107
4,799,818 A * 1/1989 Sudimak ..... A47B 57/545 108/147.13
5,884,567 A * 3/1999 Bartz, Jr. ..... A47B 57/04 108/106
6,044,988 A * 4/2000 Yang ..... A47B 57/265 108/107
6,068,143 A * 5/2000 Wang ..... A47B 57/265 108/144.11
6,253,933 B1 * 7/2001 Yang ..... A47B 57/545 108/147.12
6,257,426 B1 * 7/2001 Masunaka ..... A47B 46/00 108/107
6,364,139 B1 * 4/2002 Chen ..... A47B 57/265 108/107
6,695,156 B1 * 2/2004 Wang ..... A47B 57/265 108/147.11
6,748,878 B2 * 6/2004 Chen ..... A47B 57/265 108/147.13

(Continued)

*Primary Examiner* — Jennifer E. Novosad

(74) *Attorney, Agent, or Firm* — Che-Yang Chen; Law Offices of Scott Warmuth

(57) ABSTRACT

A shelf structure may comprise four vertical posts, a plurality of spacers, a plurality of connecting tubes and at least two shelf boards. Each of the vertical posts has a plurality of peripheral grooves separated with the same interval and sequentially formed on a surface thereof, and each of spacers comprises two arc pieces which are configured to fit together to secure the spacer on the vertical post. When an additional shelf board is needed, a user can directly mount the spacers and connecting tubes respectively on the four vertical posts to enable the additional shelf board to be assembled between the vertical posts, thereby achieving the quick-assembly effect. Moreover, the connecting tube has two engaging slots which enables an additional shelf board to be directly assembled and extended from a side of the shelf when cooperating with additional vertical posts.

5 Claims, 10 Drawing Sheets

(56) References Cited

U.S. PATENT DOCUMENTS

| | | | | |
|---|---|---|---|---|
| 7,059,484 | B1 * | 6/2006 | Goldberg | A47B 47/0083 211/153 |
| 7,478,971 | B2 * | 1/2009 | Li | A47B 57/545 108/147.13 |
| 7,543,540 | B2 * | 6/2009 | Tatematsu | A47B 47/047 108/192 |
| 7,992,730 | B2 * | 8/2011 | Huang | A47F 5/01 108/147.13 |
| 8,678,207 | B2 * | 3/2014 | Shimazaki | A47B 57/545 108/147.13 |
| 9,249,818 | B2 * | 2/2016 | Sabounjian | F16B 12/42 |
| 9,314,098 | B2 * | 4/2016 | Sabounjian | A47B 47/0083 |
| 9,380,868 | B1 * | 7/2016 | Fu | A47B 57/34 |
| 9,468,294 | B2 * | 10/2016 | Fu | A47B 96/024 |
| 9,717,331 | B2 * | 8/2017 | Sabounjian | A47B 57/545 |
| 2007/0170138 | A1 * | 7/2007 | Huang | A47B 47/0083 211/186 |
| 2008/0185357 | A1 * | 8/2008 | Chen | A47B 57/34 211/187 |
| 2016/0037915 | A1 * | 2/2016 | Fu | A47B 57/545 211/187 |
| 2017/0224106 | A1 * | 8/2017 | Sabounjian | A47B 57/545 |

* cited by examiner

SHELF STRUCTURE

FIELD OF THE INVENTION

The present invention relates to a shelf structure, and more particularly to a shelf structure with low manufacturing cost and convenient to use.

BACKGROUND OF THE INVENTION

Referring to FIG. 15, the conventional shelf (50) comprises a plurality of supporting posts (51) and a plurality of shelf boards (52), and each of the supporting posts (51) has a plurality of peripheral grooves (511) sequentially formed on a post body thereof. A plurality of locating members (53) is configured to dispose on the post body of the supporting post (51), and each of the locating members (53) comprises two arc panels which are configured to fit together to form a tapered-drum shape. Each of the locating members (53) has an engaging rib (531) protruding from an inner edge thereof. The shelf board (52) is made of metal bars through welding, and each of four corners of the shelf board (52) is connected with a connecting tube (521) through welding. A user can secure corresponding locating members (53) on the supporting posts (51) at a same height, and each of the engaging ribs (531) of the locating member (53) is configured to engage with the peripheral groove (511). Moreover, the connecting tubes (521) of the single shelf board (52) are configured to firmly couple with the locating members (53) at the same height thereby enabling the shelf board (52) to be supported by the supporting posts (51).

However, the conventional shelf is disadvantageous because: (i) the shelf board (52) is secured between the supporting posts (51) through connecting the connecting tubes (521) with the locating members (53) at the same height. In this way, each of the connecting tubes (521) has to firmly couple with the locating member (53) to steady the shelf board. As a result, after assembly, the locating members (53) cannot be moved freely and the shelf (50) has limitations when needing to add more shelf boards (52) thereon according to use conditions; and (ii) after assembly, a user cannot directly assemble additional shelf boards (52) without more supporting posts, which is inconvenient to use. Therefore, there remains a need for a new and improved design for a shelf to overcome the problems presented above.

SUMMARY OF THE INVENTION

The present invention provides a shelf structure which comprises four vertical posts, a plurality of spacers, a plurality of connecting tubes and at least two shelf boards. Each of the vertical posts has a plurality of peripheral grooves separated with the same interval and sequentially formed on a surface thereof, and each of spacers comprises two arc pieces which are configured to fit together to secure the spacer on the vertical post. Moreover, an inner surface of the arc piece has a rib which is adapted to be received in and engaged with the peripheral groove. Each of the connecting tubes has a first arc member and a second arc member, which are configured to fit together and couple around an outer periphery of the spacer, wherein the spacers and the connecting tubes are formed in a tapered-drum shape. Additionally, each of two lateral ends of the first arc member has a first engaging portion and an L-shaped first protruding piece respectively formed at a middle portion and protruding from a lower portion thereof. Also, each of two lateral ends of the second arc member comprises a second engaging portion and an L-shaped second protruding piece respectively formed at a middle portion and protruding from a lower portion thereof. The first arc member is configured to fit together with the second arc member, and the two first engaging portions of the first arc member are adapted to respectively engage with the two second engaging portions of the second arc member at corresponding positions. Furthermore, each of the two first protruding pieces is configured to abut against the corresponding second protruding piece to form an engaging slot above the first protruding piece and the second protruding piece. Each of the two shelf boards has four arc panels evenly located at two parallel edges thereof; i.e. each of the two edges has two arc panels, and the two arc panels on one edge are located at positions corresponding to the two arc panels at another edge. Furthermore, each of the arc panels comprises two engaging notches upwardly formed from a bottom edge thereof, and an engaging member is formed between the two engaging notches. In addition, the shelf board is configured to be positioned between the four vertical posts.

Comparing with conventional shelves, the present invention is advantageous because: (i) the single connecting tube is mounted on the vertical post through fitting the first arc member and the second arc member together, and the four corresponding connecting tubes are mounted on the four vertical posts at the same height such that the shelf board is configured to be horizontally assembled between the vertical posts through engaging the arc panels with the engaging slots; when an additional shelf board is needed, a user can directly mount the spacers and connecting tubes respectively on the four vertical posts to enable the additional shelf board to be assembled between the vertical posts, thereby achieving the quick-assembly effect; and (ii) the two engaging slots are respectively located at the outer periphery and inner periphery of the single vertical post, and by cooperating with two additional vertical posts, an additional shelf board is configured to be directly assembled between the two vertical posts at a designated edge of the shelf and the two additional vertical posts, which lowers the costs and greatly increases the practicability of the shelf.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
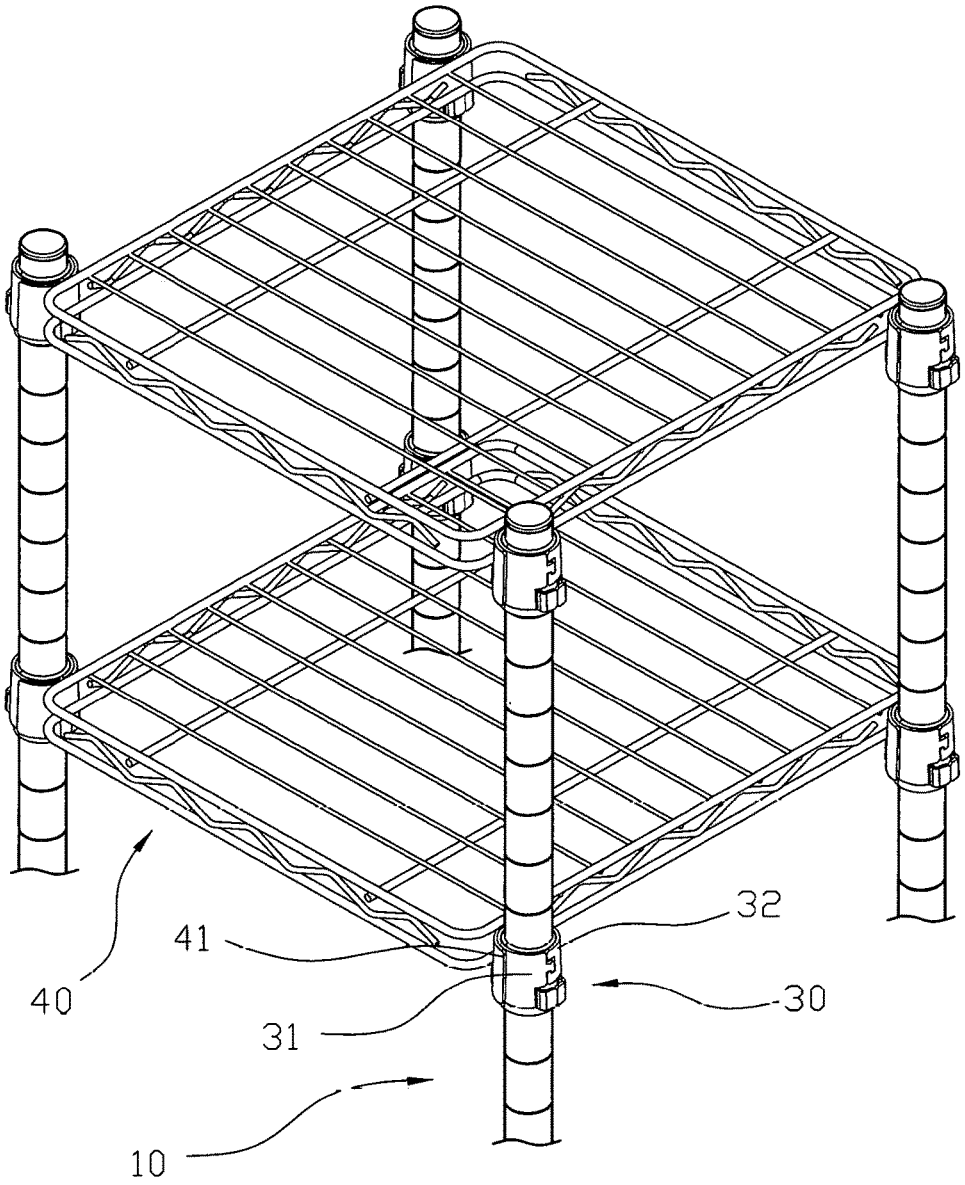
FIG. 1 is a three-dimensional assembly view of a shelf structure of the present invention.
Figure 2:
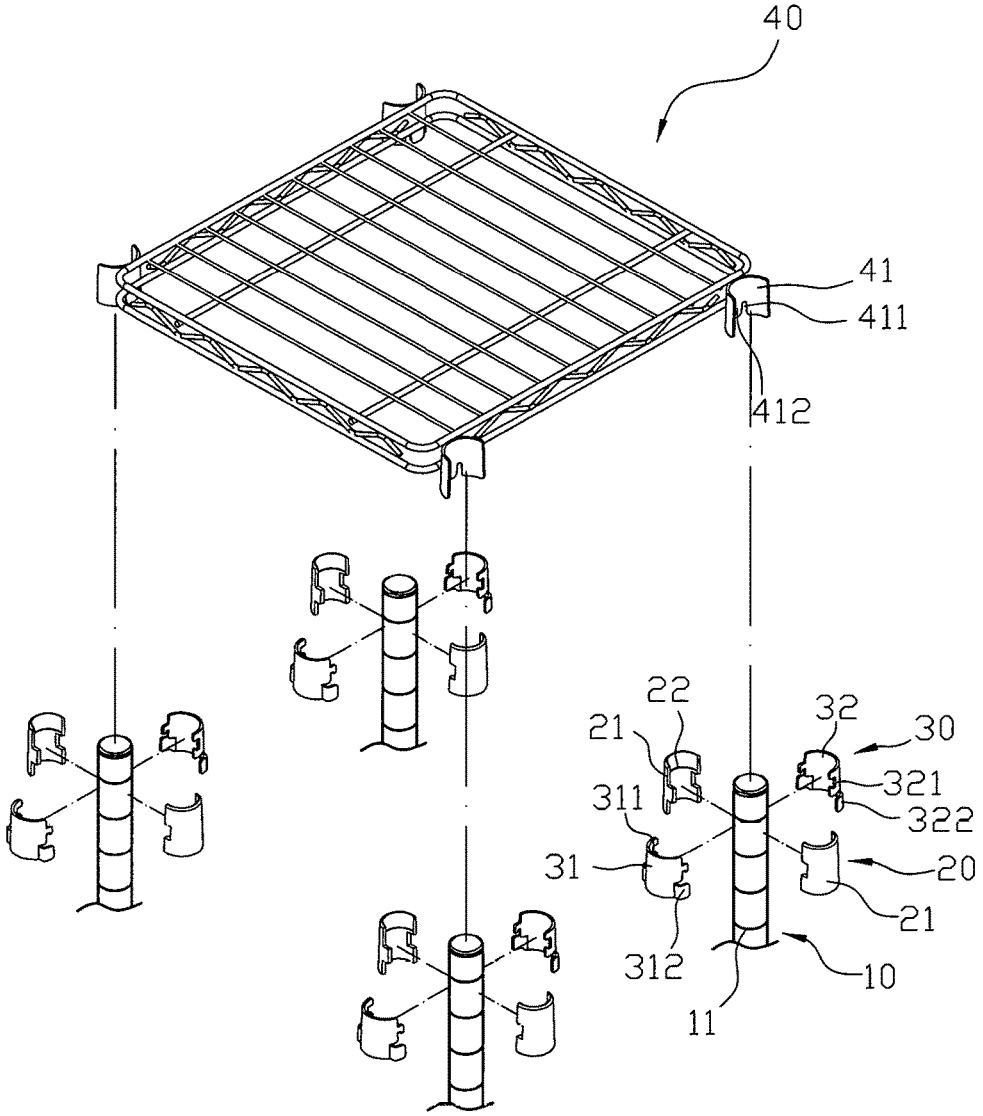
FIG. 2 is a three-dimensional exploded view of the shelf structure of the present invention.
Figure 3:
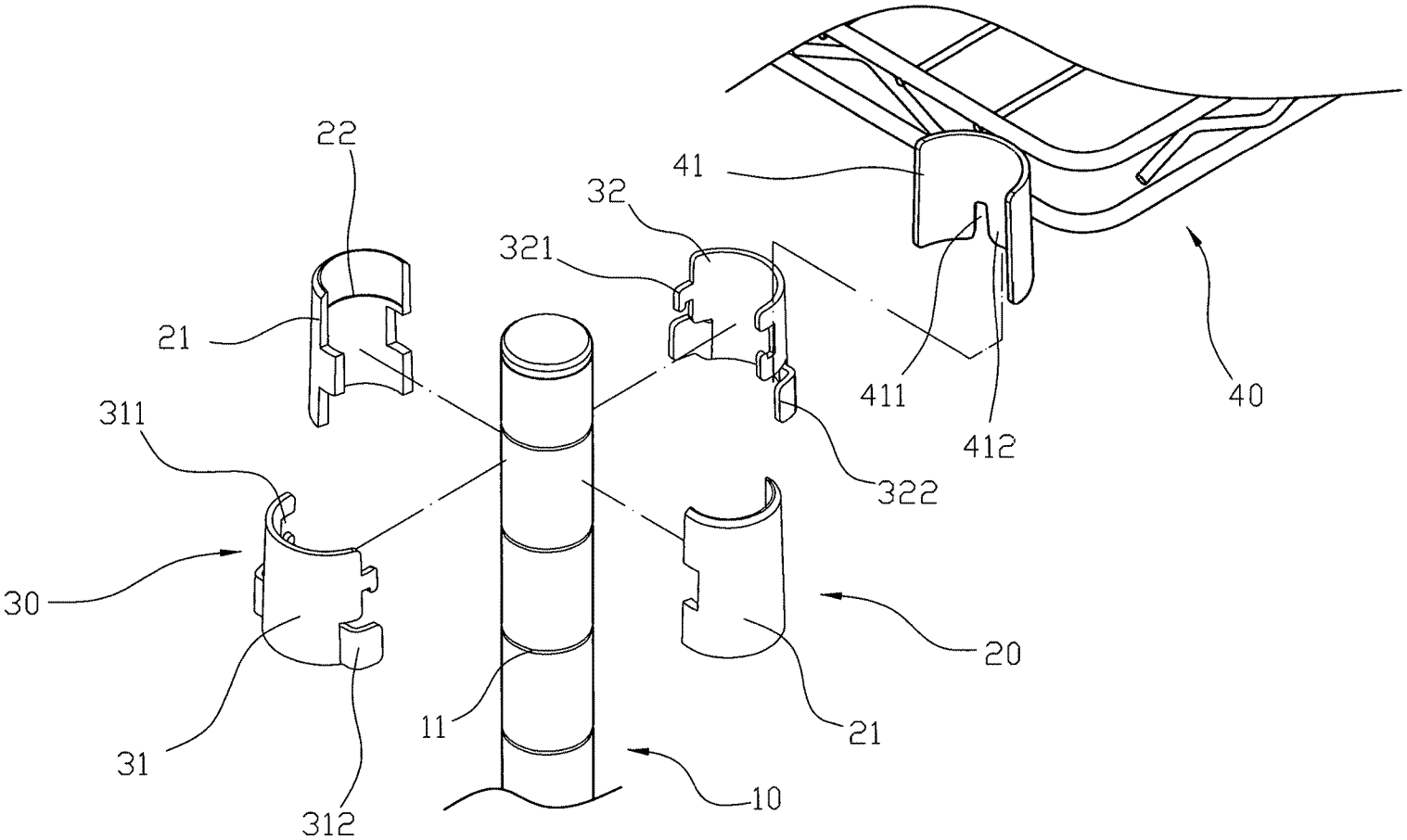
FIG. 3 is a partial exploded view of the shelf structure of the present invention.
Figure 4:
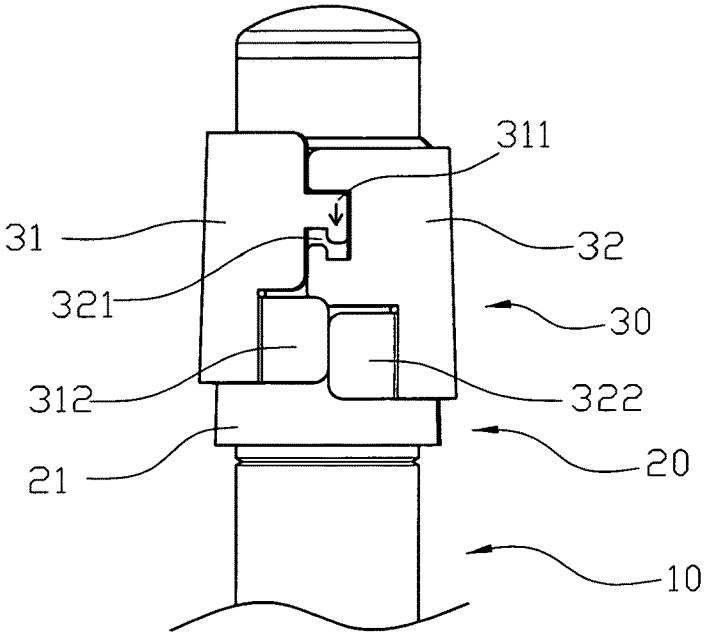
FIG. 4 is a schematic view illustrating a connecting tube is mounted on a vertical post of the shelf structure in the present invention.
Figure 5:
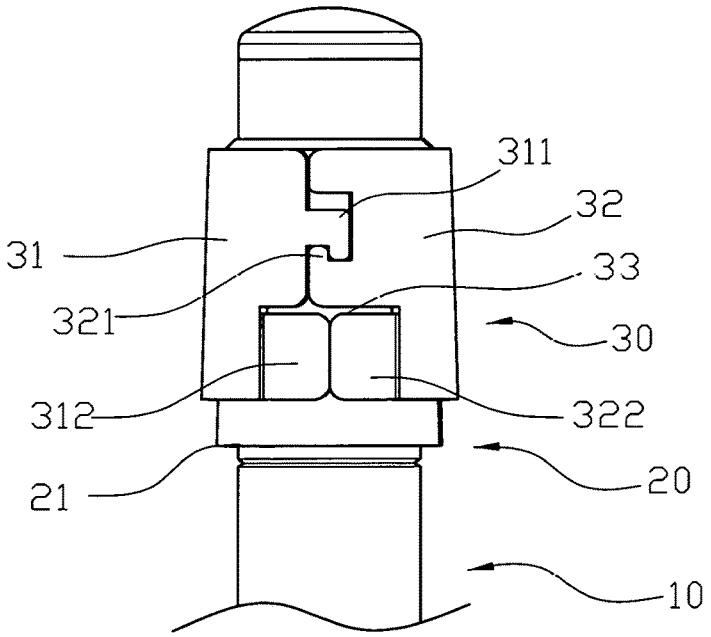
FIG. 5 is another schematic view illustrating the connecting tube is mounted on the vertical post of the shelf structure in the present invention.
Figure 6:
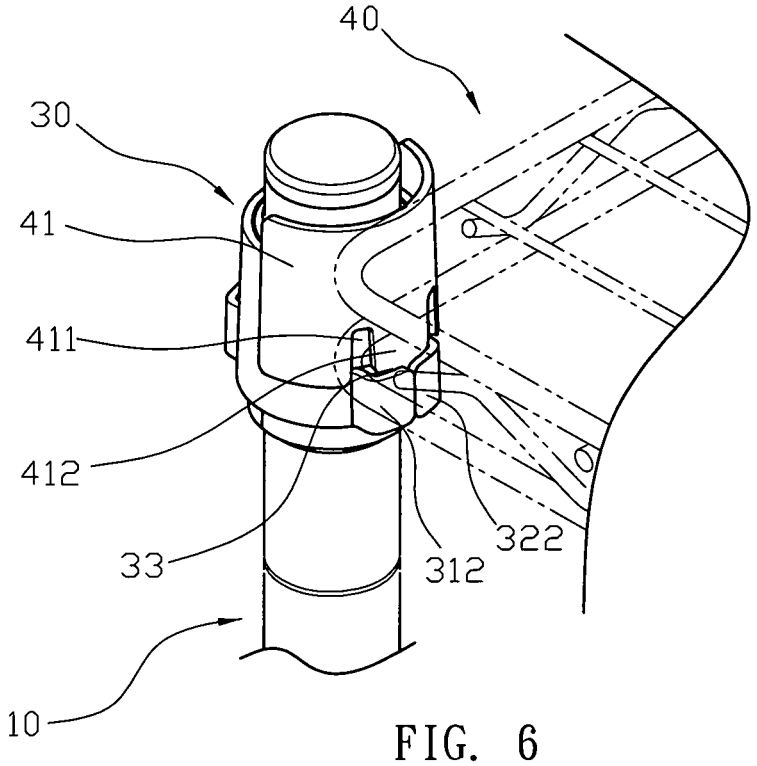
FIG. 6 is a schematic view illustrating an edge of a shelf board is engaged with the connecting tube of the shelf structure in the present invention.

In order to further understand the goal, characteristics and effect of the present invention, a number of embodiments along with the drawings are illustrated as following:

Referring to FIGS. 1 to 3, the present invention provides a shelf structure which comprises four vertical posts (10), a plurality of spacers (20), a plurality of connecting tubes (30) and at least two shelf boards (40). Each of the vertical posts (10) has a plurality of peripheral grooves (11) separated with the same interval and sequentially formed on a surface thereof, and each of spacers (20) comprises two arc pieces (21) which are configured to fit together to secure the spacer (20) on the vertical post (10). Moreover, an inner surface of the arc piece (21) has a rib (22) which is adapted to be received in and engaged with the peripheral groove (11). Each of the connecting tubes (30) has a first arc member (31) and a second arc member (32), which are configured to fit together and couple around an outer periphery of the spacer (20), wherein the spacers (20) and the connecting tubes (30) are formed in a tapered-drum shape. Additionally, each of two lateral ends of the first arc member (31) has a first engaging portion (311) and an L-shaped first protruding piece (312) respectively formed at a middle portion and protruding from a lower portion thereof. Also, each of two lateral ends of the second arc member (32) comprises a second engaging portion (321) and an L-shaped second protruding piece (322) respectively formed at a middle portion and protruding from a lower portion thereof. The first arc member (31) is configured to fit together with the second arc member (32), and the two first engaging portions (311) of the first arc member (31) are adapted to respectively engage with the two second engaging portions (321) of the second arc member (32) at corresponding positions. Furthermore, each of the two first protruding pieces (312) is configured to abut against the corresponding second protruding piece (322) to form an engaging slot (33) above the first protruding piece (312) and the second protruding piece (322). Each of the two shelf boards (40) has four arc panels (41) evenly located at two parallel edges thereof; i.e. each of the two edges has two arc panels (41), and the two arc panels (41) on one edge are located at positions corresponding to the two arc panels (41) at another edge. Furthermore, each of the arc panels (41) comprises two engaging notches (411) upwardly formed from a bottom edge thereof, and an engaging member (412) is formed between the two engaging notches (411). In addition, the shelf board (40) is configured to be positioned between the four vertical posts (10).

Figure 7:
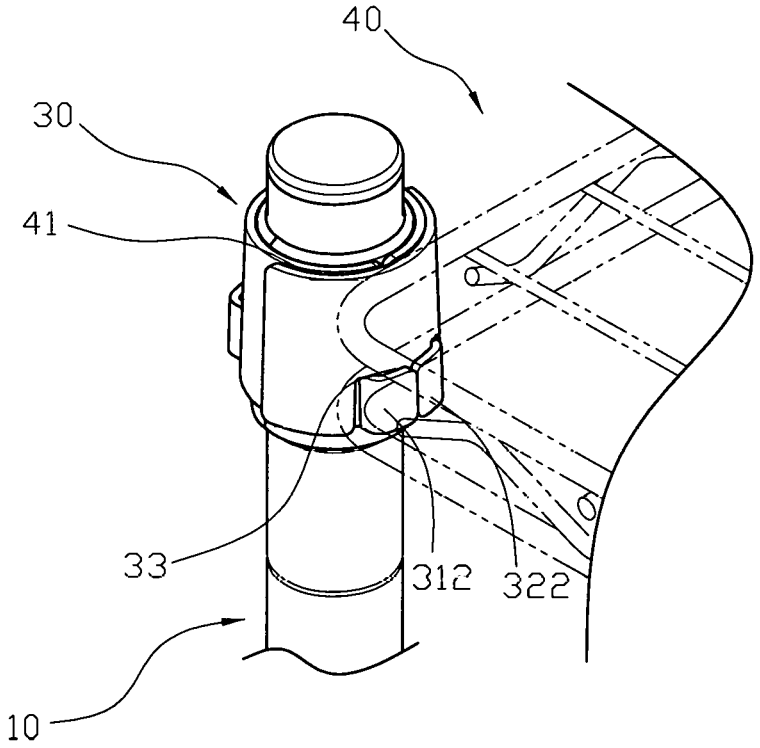
FIG. 7 is another schematic view illustrating the edge of the shelf board is engaged with the connecting tube of the shelf structure in the present invention.

Structurally, referring to FIGS. 1, to 7, the two shelf boards (40) are respectively and horizontally positioned between the four vertical posts (10) at two different height levels, and the spacers (20) are respectively and firmly coupled on the surface of the vertical posts (10) through the peripheral grooves (11). The connecting tubes (30) are respectively engaged with and limited positions by the spacers (20). In one embodiment, the two first engaging portions (311) at the two lateral ends of the first arc member (31) are respectively formed as a first fastener and a first slot, and the two second engaging portions (321) at the two lateral ends of the second arc member (32) are respectively formed as a second slot and a second fastener, which are configured to engage with the first fastener and the first slot respectively, wherein the first fastener and the second fastener are configured to be inserted into and secured inside the first slot and the second slot respectively, thus completing the assembly between the first arc member (31) and the second arc member (32). Meanwhile, the two first protruding pieces (312) on the two lateral ends of the first arc member (31) are respectively abutted against the two second protruding pieces (322) on the two lateral ends of the corresponding second arc member (32), thereby forming the two engaging slots (33) located at an inner periphery and an outer periphery of the vertical post (10) respectively. Thereafter, through the four arc panels (41) engaged with the engaging slots (33) formed at the inner peripheries of the vertical posts (10), each of the two shelf boards (40) is adapted to be engaged with the four connecting tubes (30) and firmly secured between the four vertical posts (10). In the assembly process, each of the engaging members (412) of the arc panel (41) is configured to be positioned downwardly to engaged with the engaging slot (33) located between the first protruding piece (312) and the second protruding piece (322), thereby completing the assembly.

Figure 8:
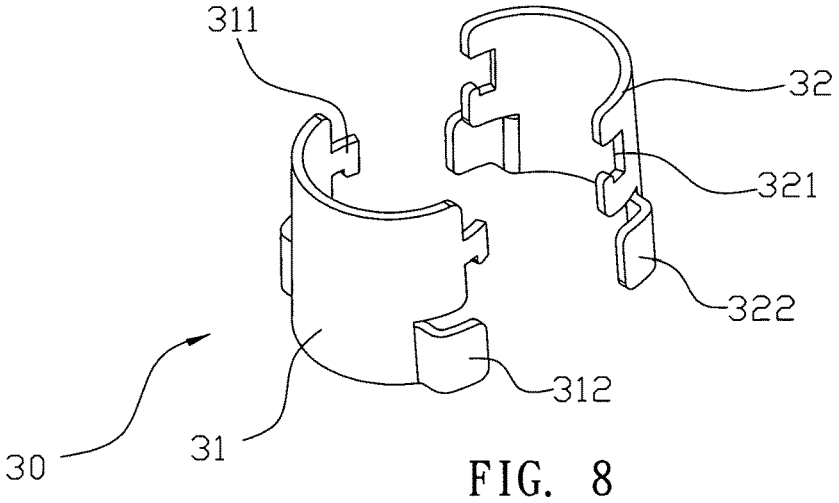
FIG. 8 is a second embodiment of the connecting tube of the shelf structure in the present invention.

In another embodiment, referring to FIG. 8, the two first engaging portions (311) at the two lateral ends of the first arc member (31) are respectively formed as two third fasteners, and the two second engaging portions (321) at the two lateral ends of the second arc member (32) are respectively formed as two third slots which are configured to respectively engage with the corresponding third fasteners, thereby completing the assembly between the first arc member (31) and the second arc member (32). Moreover, in still another embodiment, the two second engaging portions (321) are respectively formed as two fourth fasteners while the two first engaging portions (311) are respectively formed as two fourth slots, which are configured to engage with the two fourth fasteners respectively, thereby completing the assembly between the first arc member (31) and the second arc member (32).

Figure 9:
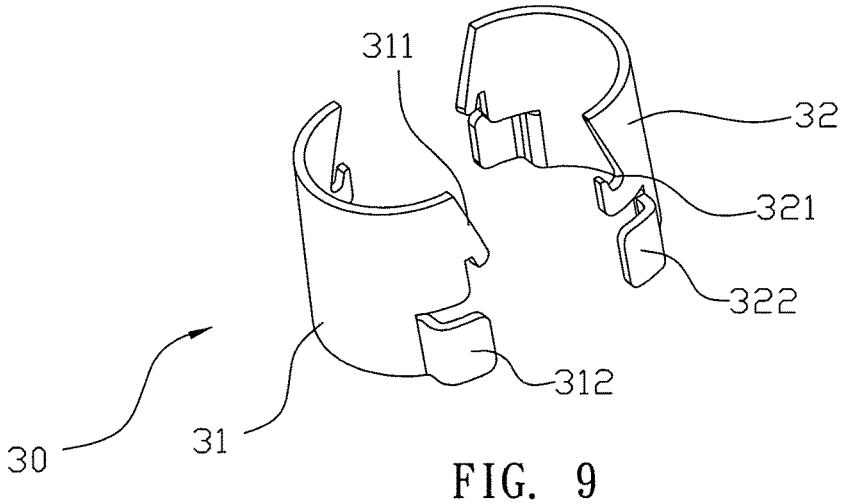
FIG. 9 is a third embodiment of the connecting tube of the shelf structure in the present invention.

In a further embodiment, referring to FIG. 9, the two first engaging portions (311) at the two lateral ends of the first arc member (31) are respectively formed as a first oblique hook and a first oblique recess, and the two second engaging portions (321) at the two lateral ends of the second arc member (32) are respectively formed as a second oblique recess and a second oblique hook, which are configured to respectively engage with the first oblique hook and the first oblique recess, thereby completing the assembly between the first arc member (31) and the second arc member (32).

Figure 10:
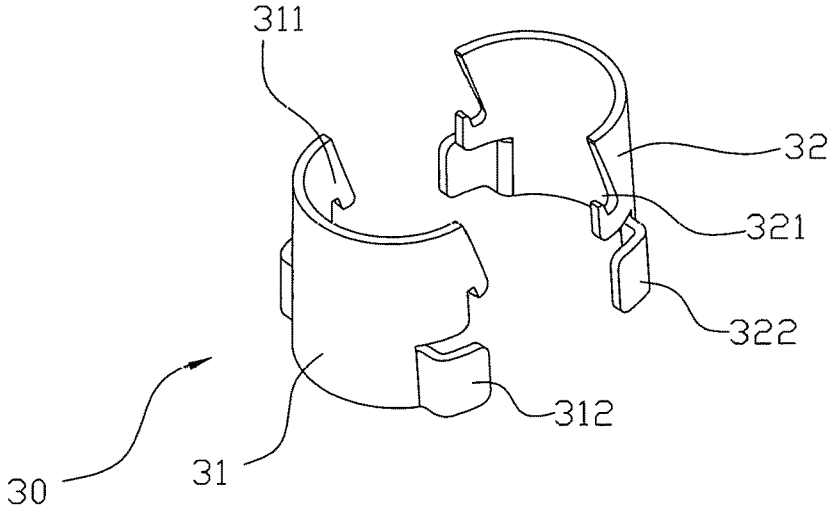
FIG. 10 is a fourth embodiment of the connecting tube of the shelf structure in the present invention.

In still a further embodiment, referring to FIG. 10, the two first engaging portions (311) at the two lateral ends of the first arc member (31) are respectively formed as two third oblique hooks, and the two second engaging portions (321) at the two lateral ends of the second arc member (32) are respectively formed as two third oblique recesses, which are configured to respectively engage with the two third oblique hooks, thereby completing the assembly between the first arc member (31) and the second arc member (32). Additionally, in yet a further embodiment, the two second engaging portions (321) are respectively formed as two fourth oblique hooks while the first second engaging portions (311) are respectively formed as two fourth oblique recesses, which are configured to engage with the two fourth oblique hooks respectively, thereby completing the assembly between the first arc member (31) and the second arc member (32).

Figure 11:
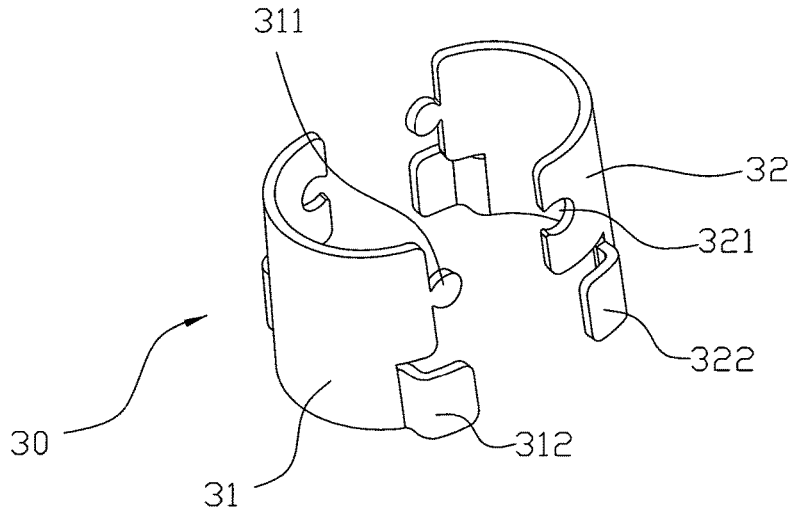
FIG. 11 is a fifth embodiment of the connecting tube of the shelf structure in the present invention.

In a particular embodiment, referring to FIG. 11, the two first engaging portions (311) at the two lateral ends of the first arc member (31) are respectively formed as a first round fastener and a first round slot respectively, and the two second engaging portions (321) at the two lateral ends of the second arc member (32) are respectively formed as a second round slot and a second round fastener, which are configured to engage with the first round fastener and the first round slot respectively, thereby completing the assembly between the first arc member (31) and the second arc member (32).

Figure 12:
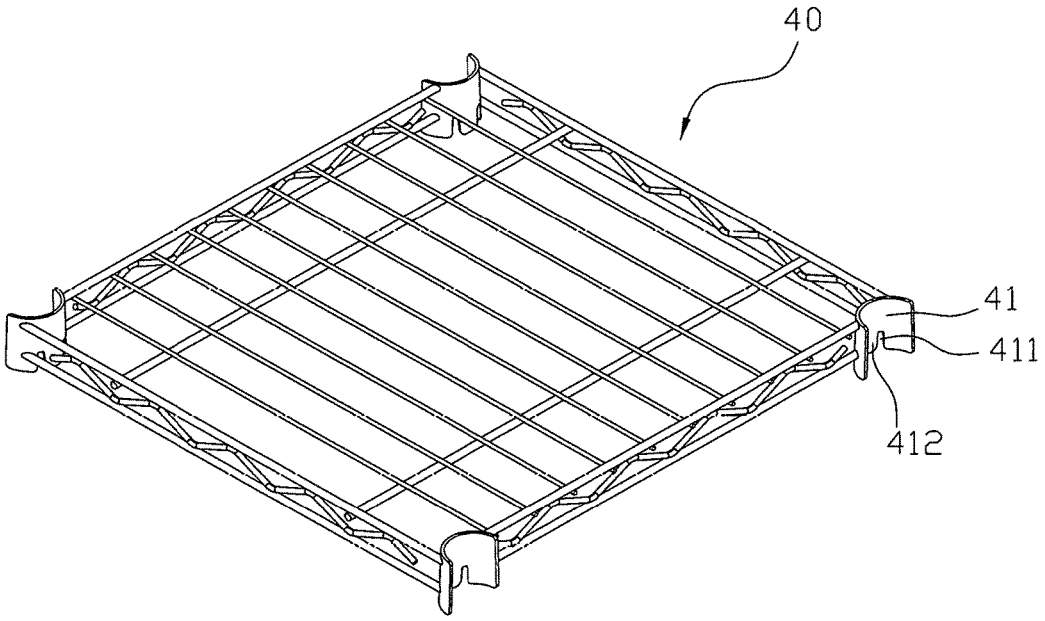
FIG. 12 is another embodiment of the shelf board of the shelf structure in the present invention.

In a preferred embodiment, referring to FIG. 12, the four arc panels (41) are configured to firmly secure on four corners of the single shelf board (40) through welding.

Figure 13:
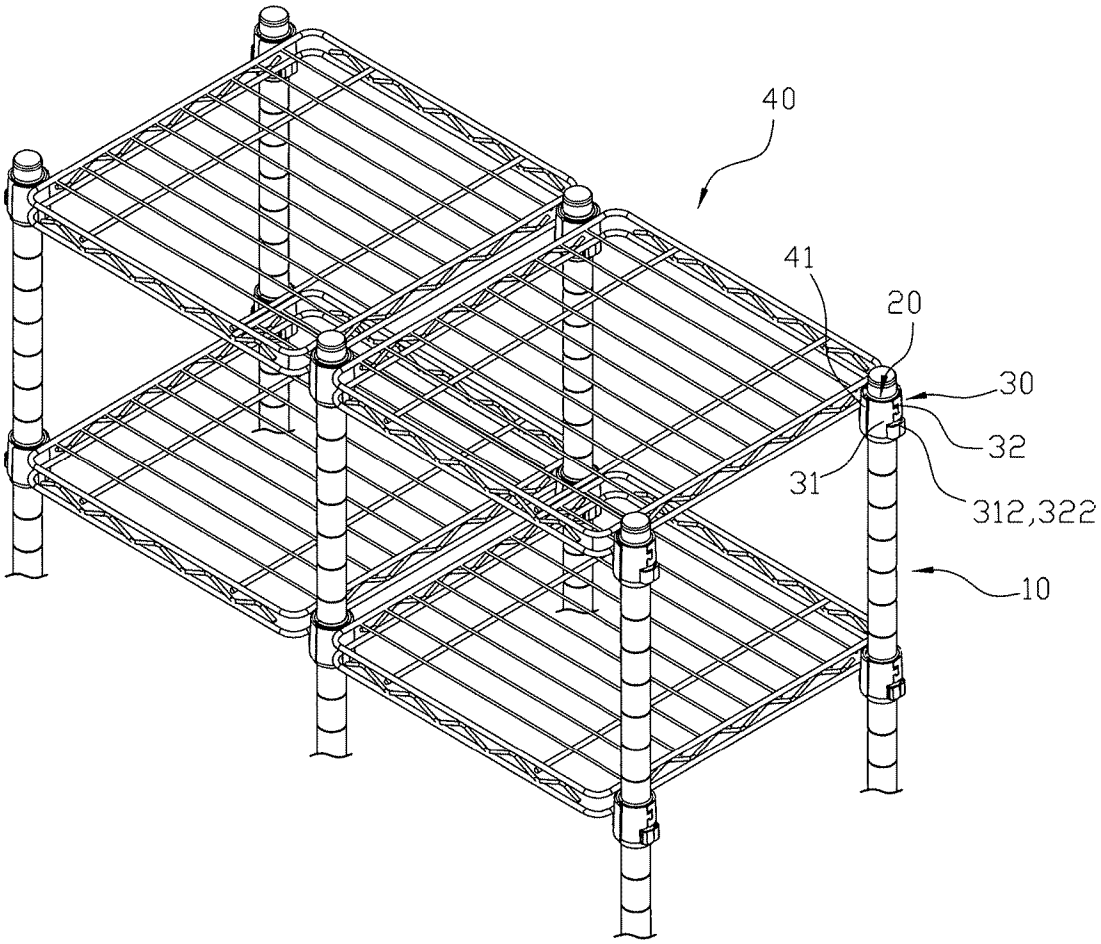
FIG. 13 is a schematic view illustrating an additional shelf board is assembled with an edge of the shelf structure in the present invention.

Moreover, referring to FIG. 13, after assembly, the two engaging slots (33) of the single connecting tube (30) are respectively located at the inner periphery and the outer periphery of the single vertical post (10), thereby enabling more shelf boards (40) to be assembled at sides of the shelf. More specifically, two additional vertical posts (10) having the spacers (20) and the connecting tubes (30) thereon are positioned at a first side of the shelf (10) and separated with a preferred distance same as the distance between the two vertical posts (10) on the first side of the shelf, and one of two engaging slots (33) on the single additional post (10) is configured to align with the engaging slot (33) at the outer periphery of the corresponding vertical post (10) on the first side of the shelf while the engaging slot (33) on the other additional post (10) is configured to align with the outer engaging slot (33) located on the other vertical post (10) on the first side of the shelf. As a result, through engaging the arc panels (41) with the engaging slots (33), an additional shelf board (40) is configured to be securely assembled between the two vertical posts (10) at the first side of the shelf and the two additional vertical posts (10) and the additional shelf board (40) is located at the same height of the corresponding shelf board (40) of the shelf, which is convenient to use. Furthermore, the shelf is configured to be extended from other edges thereof or further extended from the additional shelf board (40) in the same way.

Figure 14:
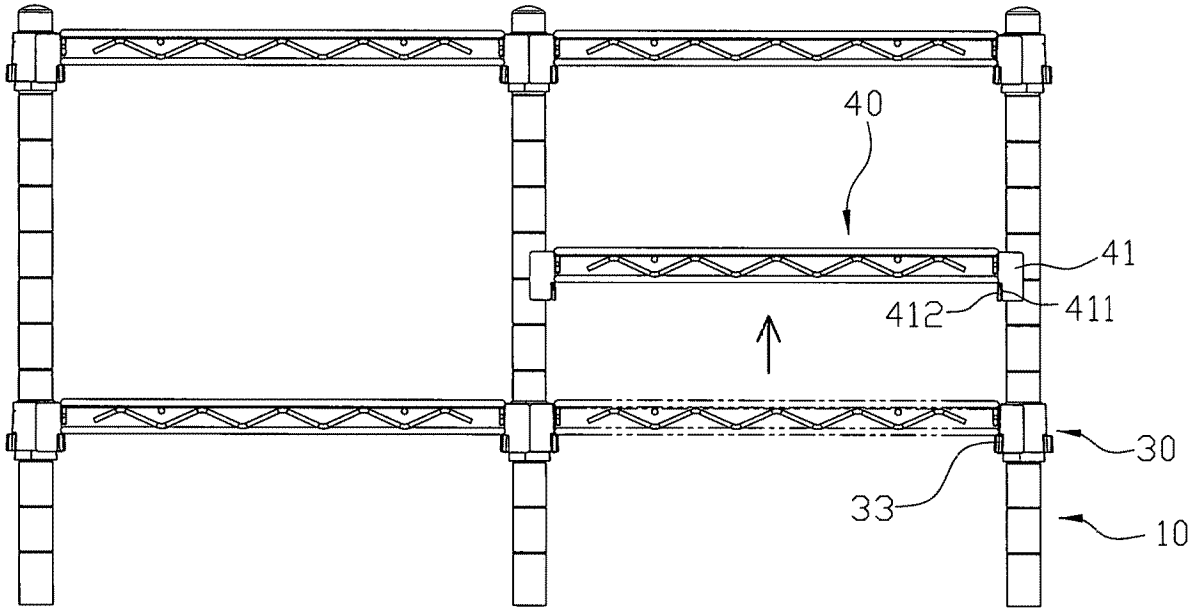
FIG. 14 is a schematic view illustrating the shelf board is disengaged from the shelf structure of the present invention.
Figure 15:
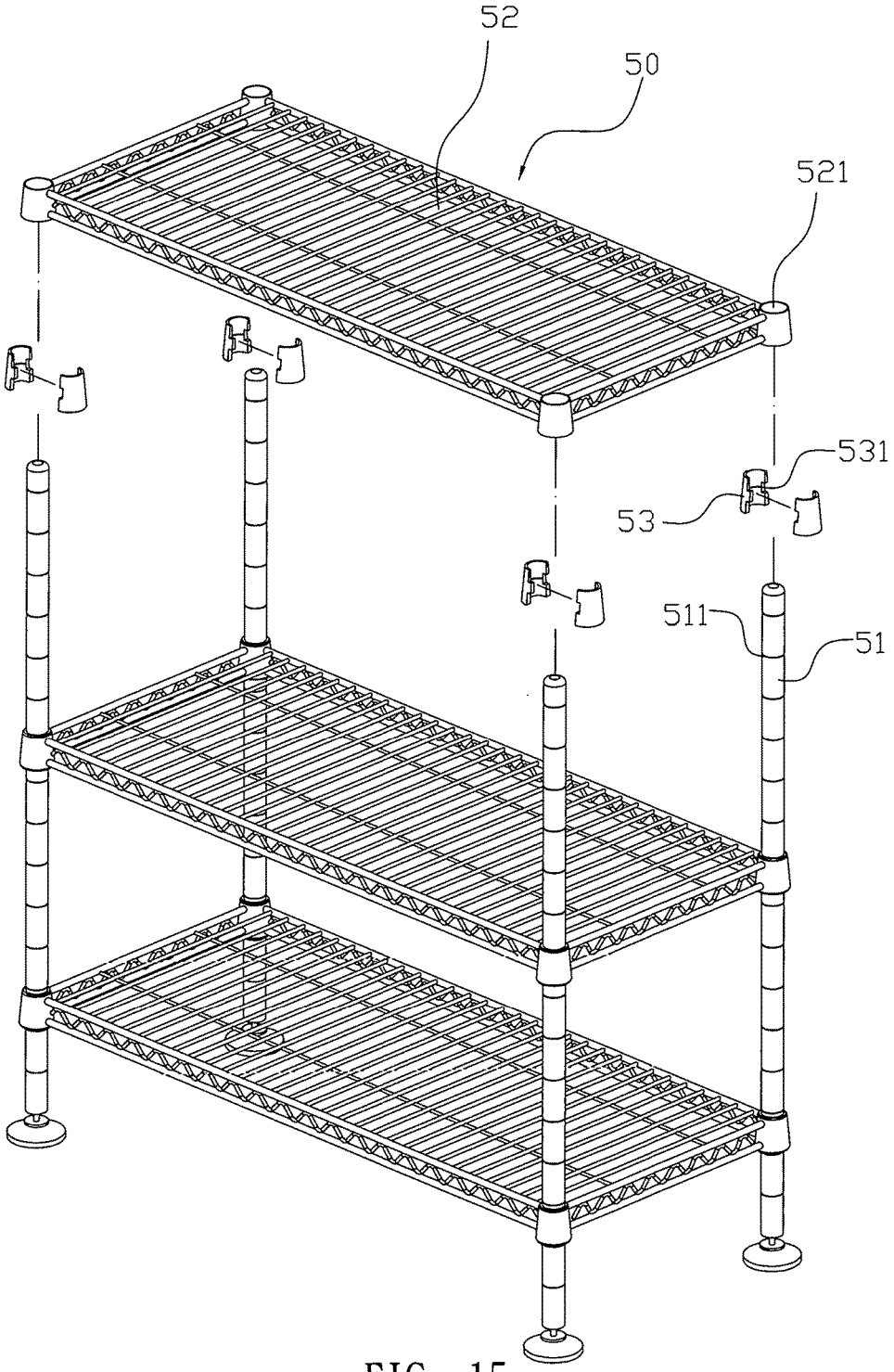
FIG. 15 PRIOR ART
FIG. 15 is a prior art.

In addition, referring to FIG. 14, since the shelf board (40) is secured between the vertical posts (10) through engaging the engaging members (412) of the arc panels (41) with the engaging slots (33) of the connecting tubes (30), a user can easily disassemble the shelf board (40) from the shelf by simply pushing the shelf board (40) upwardly to disengage the engaging members (412) from the engaging slots (33). Conversely, the shelf board (40) can be directly assembled between the vertical posts (10) with the same mechanism.

Comparing with conventional shelf, the present invention is advantageous because: (i) the single connecting tube (30) is mounted on the vertical post (10) through fitting the first arc member (31) and the second arc member (32) together, and the four corresponding connecting tubes (30) are mounted on the four vertical posts (10) at the same height such that the shelf board (40) is configured to be horizontally assembled between the vertical posts (10) through engaging the arc panels (41) with the engaging slots (33); when an additional shelf board (40) is needed, a user can directly mount the spacers (20) and connecting tubes (30) respectively on the four vertical posts (10) to enable the additional shelf board (40) to be assembled between the vertical posts (10), thereby achieving the quick-assembly effect; and (ii) the two engaging slots (33) are respectively located at the outer periphery and inner periphery of the single vertical post (10), and by cooperating with two additional vertical posts (10), an additional shelf board (40) is configured to be directly assembled between the two vertical posts (10) at a designated edge of the shelf and the two additional vertical posts (10), which lowers the costs and greatly increases the practicability of the shelf.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A shelf structure comprising:

four vertical posts; each of the vertical posts having a plurality of peripheral grooves separated with the same interval and sequentially formed on a surface thereof;

a plurality of spacers; each of the spacers comprising two arc pieces which are configured to fit together to secure the respective spacer on one of the vertical post, and an inner surface of each of the arc pieces having a rib which is adapted to be received in and engaged with the respective peripheral groove;

a plurality of connecting tubes; each of the connecting tubes comprising a first arc member and a second arc member, which are configured to fit together and couple around an outer periphery of the spacer; each of two lateral ends of the first arc member having a first engaging portion and an L-shaped first protruding piece respectively formed at a middle portion and protruding from a lower portion thereof; each of two lateral ends of the second arc member comprising a second engaging portion and an L-shaped second protruding piece respectively formed at a middle portion and protruding from a lower portion thereof; the first arc member configured to fit together with the second arc member, and each of the two first engaging portions adapted to respectively engage with the corresponding second engaging portion; and each of the two first protruding pieces configured to respectively abut against the corresponding second protruding piece to form two engaging slots at two corresponding sides of the connecting tube; and at least two shelf boards assembled between the four vertical posts through engaging with the connecting tubes mounted on the vertical posts.

2. The shelf structure of claim 1, wherein the two shelf boards are respectively and horizontally positioned between the four vertical posts at two different height levels, and each of the two shelf boards has four arc panels evenly located at two parallel edges thereof, and the two arc panels on one edge of the shelf board are located at positions corresponding to the two arc panels at another edge thereof; each of the arc panels comprises two engaging notches upwardly formed from a bottom edge thereof, and an engaging member is formed between the two engaging notches.

3. The shelf structure of claim 2, wherein the two first engaging portions at the two lateral ends of the first arc member are respectively formed as a first fastener and a first slot, and the two second engaging portions at the two lateral ends of the second arc member are respectively formed as a second slot and a second fastener, which are configured to engage with the first fastener and the first slot respectively to assemble the first arc member and the second arc member.

4. The shelf structure of claim 2, wherein the two first engaging portions at the two lateral ends of the first arc member are respectively formed as two third fasteners, and the two second engaging portions at the two lateral ends of the second arc member are respectively formed as two third slots which are configured to respectively engage with the corresponding third fasteners to assemble the first arc member and the second arc member.

5. The shelf of claim 2, wherein the two first engaging portions at the two lateral ends of the first arc member are respectively formed as a first oblique hook and a first oblique recess, and the two second engaging portions at the two lateral ends of the second arc member are respectively formed as a second oblique recess and a second oblique hook, which are configured to respectively engage with the first oblique hook and the first oblique recess to assemble the first arc member and the second arc member.

* * * * *